US005571656A

United States Patent [19]

Kingsley et al.

[11] Patent Number: 5,571,656

[45] Date of Patent: Nov. 5, 1996

[54] MULTICOLOR DIFFUSION TRANSFER PHOTOGRAPHIC FILM ELEMENTS

[75] Inventors: Edward D. Kingsley, Acton; Emmett S. McCaskill, Wellesley; Avinash C. Mehta, Belmont; Kenneth C. Waterman, Concord, all of Mass.

[73] Assignee: Polroid Corporation, Cambridge, Mass.

[21] Appl. No.: 599,044

[22] Filed: Feb. 9, 1996

[51] Int. Cl.[6] ..... G03C 8/16; G03C 8/20; G03C 8/36

[52] U.S. Cl. ..... 430/218; 430/216; 430/441; 430/443; 430/959

[58] Field of Search ..... 430/218, 216

[56] References Cited

U.S. PATENT DOCUMENTS

| | | | |
|---|---|---|---|
| 3,230,085 | 1/1966 | Dershowitz et al. | 96/29 |
| 3,329,670 | 7/1967 | Dershowitz et al. | 260/162 |
| 3,345,163 | 10/1967 | Land et al. | 96/3 |
| 3,577,236 | 5/1971 | Fix | 430/218 |
| 3,585,028 | 6/1971 | Stephens | 96/3 |
| 3,615,439 | 10/1971 | Oftedahl, Jr. | 96/29 |
| 3,816,126 | 6/1974 | Charkoudian | 430/218 |
| 4,366,240 | 12/1982 | Lassig et al. | 430/218 |
| 4,542,086 | 9/1985 | Ohki et al. | 430/218 |
| 4,724,199 | 2/1988 | Kobayashi et al. | 430/218 |
| 4,740,448 | 4/1988 | Kliem | 430/218 |
| 5,338,644 | 8/1994 | Taylor et al. | 430/218 |
| 5,415,969 | 5/1995 | Waterman | 430/215 |

*Primary Examiner*—Richard L. Schilling
*Attorney, Agent, or Firm*—Gaetano D. Maccarone

[57] ABSTRACT

There is described a multicolor diffusion transfer film unit having a plurality of different color image components, each of which includes a color-sensitive silver halide emulsion in association with a corresponding image dye-providing material and a first silver halide developer which takes part in photographic development to provide an imagewise pattern of diffusible image dye-forming material as a function of photoexposure. At least one of said color image components includes a second silver halide developer, or a precursor thereof, which is capable of developing silver halide indiscriminately and which is made available after photographic development in the color image component in which it is located is substantially completed.

12 Claims, 1 Drawing Sheet

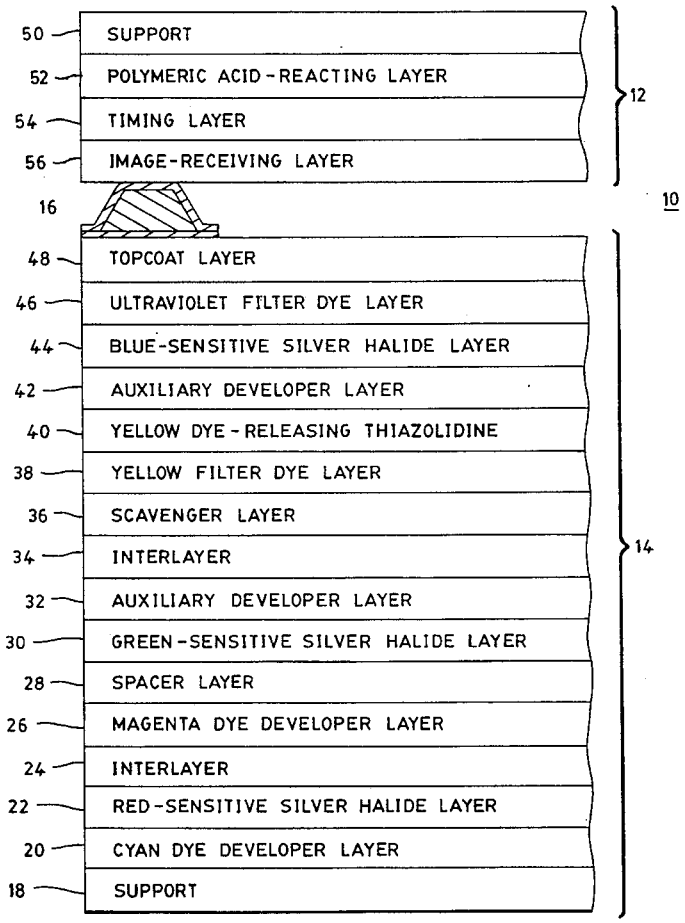

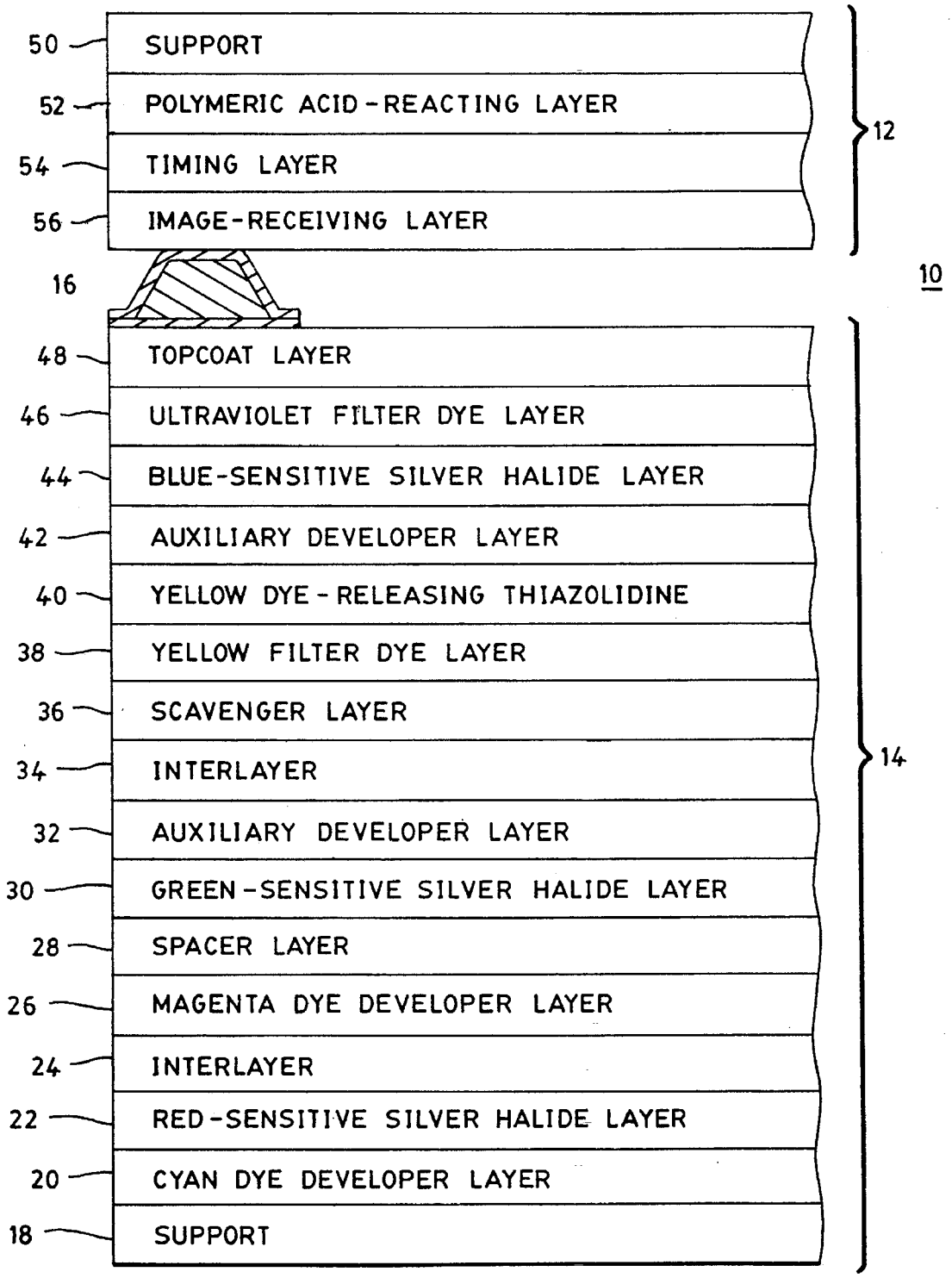
50
SUPPORT
52
POLYMERIC ACID-REACTING LAYER
54
TIMING LAYER
56
IMAGE-RECEIVING LAYER
12
16
10
48
TOPCOAT LAYER
46
ULTRAVIOLET FILTER DYE LAYER
44
BLUE-SENSITIVE SILVER HALIDE LAYER
42
AUXILIARY DEVELOPER LAYER
40
YELLOW DYE-RELEASING THIAZOLIDINE
38
YELLOW FILTER DYE LAYER
36
SCAVENGER LAYER
34
INTERLAYER
14
32
AUXILIARY DEVELOPER LAYER
30
GREEN-SENSITIVE SILVER HALIDE LAYER
28
SPACER LAYER
26
MAGENTA DYE DEVELOPER LAYER
24
INTERLAYER
22
RED-SENSITIVE SILVER HALIDE LAYER
20
CYAN DYE DEVELOPER LAYER
18
SUPPORT

MULTICOLOR DIFFUSION TRANSFER PHOTOGRAPHIC FILM ELEMENTS

This invention relates to photography and, more particularly, to novel photographic film elements and processes for forming multicolor images by diffusion transfer.

BACKGROUND OF THE INVENTION

Diffusion transfer multicolor films are well known in the art. U.S. Pat. No. 2,983,606 discloses a subtractive color film which employs red-sensitive, green-sensitive and blue-sensitive silver halide layers having associated therewith, respectively, cyan, magenta and yellow dye developers. In such films, oxidation of the dye developers in exposed areas and consequent immobilization thereof has provided the mechanism for obtaining imagewise distribution of unoxidized, diffusible cyan, magenta and yellow dye developers which are transferred by diffusion to an image-receiving layer. While a dye developer itself may develop exposed silver halide, in practice the dye developer process has utilized a colorless developing agent, sometimes referred to as an "auxiliary" developer, a "messenger" developer or an "electron transfer agent", which developing agent develops the exposed silver halide. The oxidized developing agent then participates in a redox reaction with the dye developer thereby oxidizing and immobilizing the dye developer in imagewise fashion. A well known messenger developer has been 4'-methylphenylhydroquinone (MPHQ). Commercial diffusion transfer photographic films of Polaroid Corporation including Polacolor SX-70, Time Zero and 600 have used cyan, magenta, and yellow dye developers.

U.S. Pat. Nos. 3,719,489 and 4,098,783 disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound. For convenience, these compounds may be referred to as "image dye-releasing thiazolidines". The same release mechanism is used for all three image dyes, and, as will be readily apparent, the image dye-forming system is not redox controlled.

In general, proposals to form subtractive multicolor diffusion transfer images have contemplated use of the same type of reaction to provide the requisite image-wise distributions of diffusible cyan, magenta and yellow image dyes. An exception is found in U.S. Pat. No. 3,345,163. While the preferred embodiment of said patent is the use of cyan, magenta and yellow dye developers as in Polacolor film, there is a proposal (col. 10, line 39 et seq.) to use a different reaction to control each image dye; more specifically, a proposed combination would use a tanning developer to control the cyan image dye, a coupling developer to control a magenta coupling image dye, the yellow image dye being a dye developer. In each instance, transfer of the image dye occurs where the respective developing agent was not oxidized and the image dye is diffusible unless its transfer is prevented.

Another proposal to use two different image dye control mechanisms in one film is found in U.S. Pat. No. 3,585,028. This patent proposes to use a mobile (diffusible) dye developer and an immobile (non-diffusible) image dye precursor which releases a diffusible dye following oxidation and ring-closure. In Example 1, such a combination is used to obtain a neutral image by transfer of a cyan dye developer and a "reddish" dye developer released by ring-closure, using a single silver halide emulsion layer. In Example 2 of this patent, a yellow image is obtained by transfer of a yellow dye released by oxidation of such a ring-closing precursor in addition to a yellow dye developer, again using a single silver halide emulsion layer. In each instance, oxidation of the ring-closing image dye precursor is effected as the result of development of a silver complex transferred to a nuclei layer and subsequent cross-oxidation by the oxidized form of a non-diffusible developing agent.

Another technique which utilizes two different imaging mechanisms, namely dye developers and image dye-releasing thiazolidines, is described and claimed in U.S. Pat. No. 4,740,448. According to this process the image dye positioned the greatest distance from the image-receiving layer is a dye developer and the image dye positioned closest to the image-receiving layer is provided by an image dye-releasing thiazolidine. The other image dye-providing material may be either a dye developer or an image dye-releasing thiazolidine.

In multicolor dye developer transfer processes, it has been recognized that, for example, less magenta density may be present in the transfer image than one would have predicted where there has been blue exposure but no green exposure, i.e., some magenta dye developer did not transfer even though there was no exposed green-sensitive silver halide to control its transfer. This problem is sometimes referred to as "magenta dropoff" and is believed to be the result of oxidation of the magenta dye developer as a result of the development of exposed blue-sensitive silver halide (rather than green-sensitive silver halide), the magenta dye developer being oxidized either directly or by an electron transfer redox reaction with oxidized messenger developer oxidized by exposed blue-sensitive silver halide. This undesired reaction is, at least in major part, because the magenta dye developer has to diffuse through the blue-sensitive silver halide layer to reach the image-receiving layer. In addition, the possibility has been recognized that yellow dye developer may be immobilized by development of green-sensitive silver halide, giving a different kind of crosstalk resulting in reduced yellow transfer density and increased magenta transfer density. Analogous situations may occur between the magenta and cyan dye developers. Such undesired interactions reduce color saturation and color separation and accuracy in the final image.

The photographic system taught by U.S. Pat. No. 4,740,448 reduces substantially the problem of crosstalk between adjacent silver halide emulsion layers in the formation of their respective imagewise distributions of diffusible image dyes. However, this phenomenon continues to occur in multicolor diffusion transfer photographic films such as those which utilize dye developers to provide the requisite imagewise distributions of diffusible cyan, magenta and yellow image dyes and also may occur to some extent in films which utilize dye developers together with thiazolidine image dye-providing materials dependent upon the particular photographic materials employed. It would be desirable to provide a multicolor diffusion transfer photographic film wherein such undesired interactions can be reduced substantially or virtually eliminated.

SUMMARY OF THE INVENTION

These and other objects and advantages are accomplished in accordance with the invention by providing a subtractive diffusion transfer photographic color film unit which includes a plurality of different color image components, each of which includes a color sensitive silver halide emulsion in association with a corresponding image dye-providing material and a first silver halide developer which participates, after photo exposure, in photographic development whereby there is provided an imagewise pattern of diffusible image dye-forming material. At least one of the color image components further includes a second silver halide developer, or a precursor thereof, which is more strongly reducing than the first silver halide developer and which is capable of developing silver halide indiscriminately, i.e., both exposed and unexposed silver halide. The second silver halide developer is made available on a delayed basis, i.e., after photographic development in the color image component where the second silver halide developer is located is substantially completed. By utilizing a second silver halide developer in accordance with the invention interimage effects between the different color image components can be decreased.

The second silver halide developing agent is designed to be made available within the color image component after the image dye-providing materials—whether (1) initially soluble or diffusible in the processing composition but which are selectively rendered nondiffusible imagewise as a function of development or (2) initially insoluble or nondiffusible in the processing composition but which selectively provide a diffusible product imagewise as a function of development—have participated in the reaction(s) whereby mobile and diffusible dye image-forming materials are provided in an imagewise pattern and diffuse to the intended image-image-receiving layer. For example, the second silver halide developing agent utilized according to the invention is designed to be made available after a dye developer and, when present, an auxiliary silver halide developing agent have participated in the reactions to immobilize substantially completely the exposed silver halide with which they are associated.

The sequence of reactions which occur in the color film of the invention is important in order to obtain the desired advantageous results. In the case of dye developers, initially the exposed silver halide is reduced to metallic silver by interaction with the dye developer and any auxiliary developer, thereby immobilizing the dye developer. The dye developer in the unexposed areas is allowed to diffuse to the image-receiving layer. Thus, the strongly reducing second developing agent must be made available after these interactions have been substantially completed and prior to the arrival in that location of a diffusible image dye associated with a different silver halide emulsion layer. The second silver halide developing agent, by developing indiscriminately any exposed silver halide not previously developed by interaction with the associated dye developer or auxiliary developer, operates to allow such a diffusible image dye associated with a different silver halide emulsion layer to diffuse to the image-receiving layer.

The strongly reducing second silver halide developing agent may be made available on a delayed basis in accordance with the invention by a number of techniques. For example, a developing agent which has a relatively slow dissolution rate in alkali can be utilized. Alternatively, a silver halide developing agent precursor which will provide such a silver halide developing agent upon reaction or interaction with alkali may be utilized.

In a preferred embodiment the novel subtractive color diffusion transfer film of the invention employs a combination of dye developers and thiazolidines as image-dye providing materials. In a particularly preferred embodiment the film includes a cyan dye developer, a magenta dye developer and a yellow image dye-releasing thiazolidine.

BRIEF DESCRIPTION OF THE DRAWING

For a better understanding of the invention as well as other objects and further features thereof, reference is made to the following detailed description of various preferred embodiments thereof taken in conjunction with the accompanying drawing wherein the FIGURE is a partially schematic, cross-sectional view of a preferred embodiment of a film unit according to the invention.

DETAILED DESCRIPTION OF THE PREFERRED EMBODIMENTS

The multicolor diffusion transfer photographic film units of the invention include those where the photosensitive element and the image-receiving element are maintained in superposed relationship before, during and after exposure as described in U.S. Pat. No. 3,415,644. Such film units are typically referred to in the art as "integral" film units. In commercial embodiments of this type of film (e.g. SX-70 film) the support for the photosensitive element is opaque, the support for the image-receiving element is transparent and a light-reflecting layer against which the image formed in the image-receiving layer may be viewed is formed by distributing a layer of processing composition containing a light-reflecting pigment (titanium dioxide) between the superposed elements. By also incorporating suitable pH-sensitive optical filter agents, preferably pH-sensitive phthalein dyes, in the processing composition, as described in U.S. Pat. No. 3,647,347, the film unit may be ejected from the camera immediately after the processing composition has been applied with the process being completed in ambient light while the photographer watches the transfer image emerge.

A particularly preferred type of film unit according to the invention is that where the image-receiving element is designed to be separated from a photosensitive element after exposure and photographic processing, the so-called "peel-apart" films.

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye-providing material may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. It should be noted that the particular image component may contain other layers such as interlayers and timing layers. In a film unit of the type described in U.S. Pat. No. 3,415,644 the red sandwich or image component is positioned closest to the support for the photosensitive element, and the blue image component is positioned the farthest from said support and closest to the image-receiving layer. In a film unit of the type described in U.S. Pat. No. 3,594,165 the red image component is closest to the support for the photosensitive element, and it also is the closest to the image-receiving layer since said layer is carried by the same support. Accordingly, the blue image component is most distant from said support and from the image-receiving layer.

The present invention may be practiced with any multicolor diffusion transfer photographic film units and these film units may include any image dye-providing materials. The image dye-providing materials can be characterized as either (1) initially soluble or diffusible in the processing composition but which are selectively rendered nondiffusible as a function of development or (2) initially insoluble or nondiffusible in the processing composition but which selectively provide a diffusible product imagewise as a function of development. The image dye-providing materials may be complete dyes or dye intermediates, e.g., color couplers.

The requisite difference in solubility or mobility may be obtained, for example, by a chemical reaction such as a redox reaction as is the case with dye developers or by a silver-assisted cleavage reaction as is the case with thiazolidines. Other image-forming mechanisms known for use in diffusion transfer photographic film units are those where a redox reaction is utilized in developed areas to release a diffusible image dye from a p-sulfonamidophenol or a p-sulfonamidonaphthol precursor, those which utilize a similar dye release redox reaction using m-sulfonamidophenol precursors and those which utilize a dye release mechanism in which a quinone precursor is reduced imagewise in underdeveloped areas to release a diffusible image dye. As noted previously, more than one image-forming mechanism may be utilized in multicolor diffusion transfer film units.

For convenience, further description of the invention will be made with reference to the figure which illustrates a preferred embodiment of the invention which is adapted for use as a peel-apart diffusion transfer photographic film unit. In the particularly preferred embodiments of the invention the cyan and magenta image dyes are dye developers and the yellow image dye is a thiazolidine. In a particularly preferred embodiment the red sandwich, or image component, is positioned closest to the support for the photosensitive element and the blue image component is positioned farthest from the support of the photosensitive element and closest to the image-receiving layer.

As shown in the figure the film unit 10 includes a photosensitive element 12 and an image-receiving element 14 arranged in superposed relationship with a rupturable pod 16, releasably holding a processing composition, arranged between the photosensitive and image-receiving elements.

The photosensitive element 14 comprises an opaque support 18 carrying, in sequence, a cyan dye developer layer 20, a red-sensitive silver halide emulsion layer 22, an interlayer 24, a magenta dye developer layer 26, a spacer layer 28, a green-sensitive silver halide layer 30, a messenger silver halide developer layer 32, an interlayer 34, a scavenger/magenta filter dye layer 36, a yellow filter dye layer 38, a yellow image dye-releasing thiazolidine layer 40, a silver halide developing agent layer 42, a blue-sensitive silver halide layer 44, an ultraviolet filter dye layer 46 and a gelatin topcoat layer 48.

The image-receiving element 12 comprises an opaque support 50, a polymeric acid-reacting layer 52, a timing layer 54 and an image-receiving layer 56.

In a preferred mode of operation the photosensitive element 14 is exposed to an image through topcoat layer 48, the photosensitive element being so positioned in the camera that light entering through the camera exposure, or lens, system is incident upon the outer, or exposure, surface, of the photosensitive element. After exposure, the photosensitive element 14 is brought into superposed relationship with image-receiving element 12 with processing composition container 16 arranged between them (as illustrated). The assemblage is then advanced between suitable pressure—applying members, or rollers, which operate to distribute uniformly the aqueous alkaline processing composition between the photosensitive and image-receiving elements and thereby initiate development of the exposed photosensitive element with the result that there is provided an imagewise distribution of cyan, magenta and yellow image dye-providing materials. The image dye-providing materials are transferred selectively, at least in part, by diffusion to the image-receiving layer. The image-receiving layer is capable of mordanting or otherwise fixing the image dye-providing materials and retains the transferred image for viewing. The image is viewed in the image-receiving layer upon separation of the image-receiving element 12 from photosensitive element 14.

In the blue image component which is contacted first by the aqueous alkaline processing composition, the exposed blue-sensitive silver halide is developed by a colorless silver halide developing agent (which will be described in more detail below) initially present in layer 42. Unexposed blue-sensitive silver halide is dissolved by a silver solvent initially present in the processing composition and transferred to layer 40 containing a yellow image dye-releasing thiazolidine. Reaction with the complexed silver initiates a cleavage of the thiazolidine ring and release of a diffusible yellow image dye as described, for example, in the previously mentioned U.S. Pat. Nos. 3,719,489 and 4,098,783.

Development of the exposed green-sensitive and red-sensitive silver halide, preferably by an auxiliary, or messenger, developer, preferably bis-(2,3-acetamidomethyl) norbornyl hydroquinone ("AMNHQ"), results in the imagewise immobilization of the magenta and cyan dye developers, respectively. Unoxidized magenta and cyan dye developers in unexposed areas of the green- and red-sensitive silver halide emulsions remain diffusible and transfer to image-receiving layer 56 through the developed blue-sensitive silver halide emulsion layer 44. Transfer of the imagewise-released yellow image dye and the imagewise unoxidized magenta and cyan dye developers to the image-receiving layer is effective to provide the desired multicolor image.

The use of an image dye-releasing thiazolidine permits the use of much lower coverages of blue-sensitive silver halide than are used with a yellow dye developer. In turn this means that the diffusing magenta dye developer is much less likely to be oxidized by development of exposed blue-sensitive silver halide thereby reducing the likelihood of magenta dropoff. By the use of appropriate spacer layers or interlayers to provide a controlled delay between development of the blue-sensitive silver halide emulsion and development of the green-sensitive silver halide emulsion, the chance of magenta dye developer being oxidized by exposed blue-sensitive silver halide is further reduced.

As noted above, the magenta and cyan dye developers may be immobilized by a cross-oxidation, or redox, reaction with oxidized messenger developer, e.g. AMNHQ. The messenger developer is substantially colorless in its reduced form. The oxidation potential of the messenger developer should be sufficiently less negative than that of the dye developers such that the dye developer will have a more negative oxidation potential than the oxidized messenger developer.

As used herein, the expression "oxidation potential" or "$E_{1/2}$" refers to the "polarographic half wave potential" of the developing agent as measured in 1 molar KOH (pH 14) at 25° C. using a rotating platinum electrode and a saturated calomel electrode ("S.C.E.") as a reference electrode, and expressed in millivolts (mv). The more negative the $E_{1/2}$ is, the more reducing the compound is.

A currently preferred messenger developer is AMNHQ which has an $E_{1/2}$ of −220 mv. This oxidation potential is much less negative than that of the currently preferred magenta dye developer (illustrated in Example I) which has an $E_{1/2}$ of −300 mv and also much less negative than that of the currently preferred cyan dye developer (also illustrated in Example I) which has an $E_{1/2}$ of −275 mv. Accordingly, AMNHQ is an effective messenger developer.

The developing agent for the blue-sensitive silver halide emulsion is also substantially colorless and may be referred to for convenience here as the "primary developer" or the "colorless developing agent". The oxidation potential of this developing agent must be sufficiently negative that its oxidation product will not cross-oxidize the magenta or cyan dye developers. If such cross-oxidation were to occur, undesirable cross-talk could result if the oxidized colorless developing agent diffused into the green or red image component layers, or if it oxidized dye developer diffusing through the blue image component layers. Accordingly, it is desirable that the colorless developing agent used in film units containing the preferred magenta and cyan dye developers have an $E_{1/2}$ at least as negative as −300 mv. In preferred embodiments the colorless developing agent has an $E_{1/2}$ at least as negative as −360 mv. Examples of suitable colorless developing agents for use in such film units are described in previously mentioned U.S. Pat. No. 4,740,448.

As will be apparent from the foregoing the interactions which occur in the blue image component should be substantially completely finished prior to the time that cyan and magenta image dye-providing materials from, respectively, the red and green image components diffuse through the blue image component to reach the image-receiving layer 56. In the event that some undeveloped, exposed (or fogged) silver halide remains in the blue-sensitive silver halide emulsion layer 44 it can have an impact on the magenta dye developer diffusing through the blue image component. Some of the diffusible magenta dye developer will develop the previously undeveloped exposed silver halide in the blue-sensitive silver halide layer and become immobilized there with the result that the desired amount of diffusible magenta dye developer will not reach the image-receiving layer. As noted previously, this phenomenon leads to "magenta dropoff", a loss of green saturation in the finished image.

The same situation pertains with diffusible cyan dye developer when it reaches the green image component. If there is residual exposed, or fogged, silver halide it can prevent some of the diffusible cyan dye developer from reaching the image-receiving layer thus resulting in cyan dropoff, a loss of red saturation.

In accordance with the invention such undesired interactions are substantially reduced, or virtually eliminated, by making available on a delayed basis in the green and/or blue image components a strongly reducing silver halide developer which is non-discriminatory, that is, it develops exposed and unexposed silver halide. Accordingly, it is critical to the ability of the color film to provide the desired photograph that such second silver halide developer(s) not be available until the primary developer—the silver halide developing agent in the case of the thiazolidine image dye-providing material and the dye developer and, when present, the messenger developer in the case of the dye developer image dye-providing material—have developed the exposed silver halide as described above.

The strongly reducing silver halide developers utilized according to the invention have relatively high oxidation potentials. As mentioned earlier the more negative the $E_{1/2}$ of the developer the more reducing it is. The strongly reducing silver halide developers incorporated in, or formed or liberated in, any diffusion transfer photographic film unit should have an oxidation potential which is sufficient to develop indiscriminately all the silver halide in the particular color component with which it is associated. It will be appreciated by those skilled in the art that the oxidation potential required to provide the desired indiscriminate development will vary according to the photographic imaging system involved and the materials used in the system. Photographic testing can be carried out to determine the specific strongly reducing silver halide developer(s) which will provide optimum results for any diffusion transfer photographic film unit. In the particularly preferred film units of the invention where the image dye-providing materials in the red and green color components are both dye developers, the strongly reducing silver halide developers generally have an $E_{1/2}$ of about −400 mv or more negative and preferably from about −450 mv to about −550 mv.

As noted previously, such strongly reducing developers can be made available on a delayed basis by resort to different characteristics of compounds. In one type, a high oxidation potential silver halide developing agent which has a relatively slow dissolution rate in alkali can be used. Typical of such developing agents are ditertiarybutylhydroquinone (DTBHQ), ditertiaryamylhydroquinone, ditertiaryoctylhydroquinone, norbornyltertiaryoctylhydroquinone and 2,3,5,6-tetramethylhydroquinone. The 90% dissolution rate for a DTBHQ dispersion in water, measured in KOH is about 1 to 3 seconds. In the preferred film unit of the invention wherein the image dye-providing material of the blue color component (that closest to the image-receiving layer)is a thiazolidine, experiments have shown that peak development occurs in about one second. Accordingly, DTBHQ is an effective strongly reducing silver halide developer for the blue color component of the film unit. A preferred strongly reducing silver halide developer for use according to the invention is 2,5-DTBHQ which has an $E_{1/2}$=−450 mv.

Another technique for making a high oxidation potential developer available on a delayed basis is to incorporate in the appropriate color image component a precursor which will undergo a reaction or interaction with alkali to release the developing agent. A preferred class of materials of this type is represented by the formula

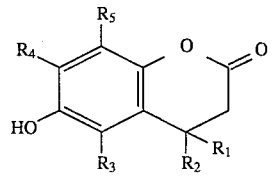

wherein $R_1$ and $R_2$ are each methyl and $R_3$, $R_4$, and $R_5$ can each independently be hydrogen, alkyl having from 1 to 4 carbon atoms or alkoxy having 1 to 4 carbon atoms. The gem dimethyl group ($R_1$ and $R_2$) maintains the lactone ring in the closed position, as desired, at neutral pH. By selecting appropriate substituents for $R_3$, $R_4$ and $R_5$, compounds having a desired oxidation potential can be provided. For example, a methyl group can provide an increase of approximately −50 mv in $E_{1/2}$ and a methoxy group can provide an increase of approximately −100 mv. The rate at which ring opening occurs can also be modulated by the choice of substituents for $R_3$, $R_4$, and $R_5$.

A lactone compound within the formula where $R_3$ is methyl and $R_4$ and $R_5$ each hydrogen has an $E_{1/2}$=−430 mv.

A particularly preferred lactone compound, namely 6-hydroxy-4,4,5,7,8-pentamethyl dihydrocoumarin, ($R_3$, $R_4$ and $R_5$ are each methyl) has an $E_{1/2}$=−493 mv.

At pH in the range of from about 10 to 14 these compounds undergo hydrolytic ring opening to produce hydroquinones which have an oxidation potential in the desired range, i.e., from about −400 mv to more negative.

In the preferred film unit according to the invention wherein the image dye-providing material of the green color component is a magenta dye developer and the green color component is arranged between the red and blue color components, experiments have shown that peak development occurs in approximately 5 seconds. It will be appreciated by those skilled in the art that the peak development time is primarily a function of the alkali arrival time. The rate of development is also dependent upon the oxidation potential of the silver halide developer and the developer concentration.

As noted above, experiments can be conducted to determine the specific strongly reducing silver halide developer(s) which are suitable for a diffusion transfer photographic film unit and, more particularly, for a color image component of the film unit. The particularly preferred lactone compound, 6-hydroxy-4,4,5,7,8-pentamethyl dihydrocoumarin, has been shown to be an effective second developer for the green color component. That is, ring opening occurs after peak development has been substantially completed and the developer made available on the delayed basis, is available to develop any remaining silver halide. Further, since such lactone compounds will undergo cyclization at neutral pH, when the pH of the alkaline environment within the film unit is reduced after photographic development as a result of interaction with an acid-neutralizing layer which is typically present in the film unit as is well known in the art, the cyclized compound can no longer develop silver halide.

Other mechanisms can be exploited to make strongly reducing silver halide developers available on a delayed basis in accordance with the invention. One such technique is to block one or both of the hydroxyl groups of a hydroquinone developer with alkali-cleavable, or hydrolyzable, groups such as, for example, acetates, carbamates, carbonates and the like, which will hydrolyze in alkali. Also, one or both of the hydroxyl groups may be blocked with a group which cleaves in alkali by quinone-methide elimination, by β-elimination or by hydrolysis followed by quinone-methide elimination. Groups of these types are well known in the art. See, for example, U.S. Pat. No. 4,390,613.

As described previously, the multicolor film units of the invention include at least two and preferably three, differently colored image components, e.g., red, green and blue and that each of these image components can include a number of layers such as a silver halide emulsion layer, a layer of associated image dye-providing material, an interlayer, a timing layer and a color filter dye layer. The second developer material according to the invention may be positioned in any layer of the color image component. The preferred location in any particular instance is dependent on various factors such as timing considerations and sensitometry considerations such as those related to processing temperature latitude. Routine scoping tests may be conducted to determine the optimum amount and location for these second developers for any image component in the multicolor film units. In a preferred embodiment a second, strongly reducing silver halide developer is positioned in each of the green and blue color image components of the film unit.

It will be understood that the photosensitive and image-receiving elements may include layers other than those illustrated as is known in the art. For example, the image-receiving element may include a strip-coat layer which is designed to facilitate separation of the photosensitive and image-receiving layers after photographic processing and may also include an overcoat layer such as is described in U.S. Pat. No. 5,415,969.

The invention will now be further described with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

A control diffusion transfer photographic film unit was prepared wherein the image-receiving element comprised an opaque polyethylene-clad paper support carrying in succession:

1. a polymeric acid-reacting layer at a coverage of about 24,219 mg/m2, comprising 9 parts GANTREZ™ S-97 (a free acid of a copolymer of methyl vinyl ether and maleic anhydride available from the GAF Corp.), and 11 parts AIRFLEXtm 465 (a vinyl acetate ethylene latex available from the Air Products Co.);
2. a timing layer coated at a coverage of about 4844 mg/m2 comprising a graft polymer including the following materials in the approximate relative ratios indicated in parenthesis: a copolymer of diacetone acrylamide (8.2) and acrylamide (1.1) grafted onto polyvinyl alcohol (1);
3. an image-receiving layer coated at a coverage of about 2960 mg/m2 comprising: 2 parts of a copolymer of vinylbenzyltrimethylammonium chloride, vinylbenzyltriethylammonium chloride and vinylbenzyldimethyldodecylammonium chloride and 1 part AIRVOL™ 165 (a superhydrolyzed polyvinyl alcohol available from Air Products Co.) and
4. a strip-coat layer coated at a coverage of about 269 mg/m$^2$ of Goodrite™ K7200N (polyacrylic acid available from the B. F. Goodrich Co.).

The photosensitive element comprised an opaque subcoated polyethylene terephthalate photographic film base having coated thereon in succession:

1. a cyan dye developer layer comprising about 734 mg/m$^2$ of the cyan dye developer represented by the formula

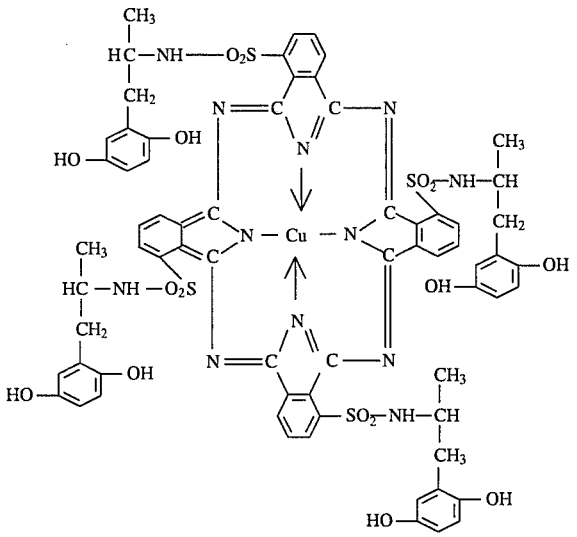

about 100 mg/m$^2$ of AMNHQ and about 412 mg/m$^2$ of gelatin;

2. a red-sensitive silver iodobromide layer comprising about 612 mg/m$^2$ of silver iodobromide (0.7 micron), about 418 mg/m$^2$ of silver iodobromide (1.55 micron) and about 555 mg/m$^2$ of gelatin;
3. an interlayer comprising about 2300 mg/m$^2$ of a copolymer of butyl acrylate/diacetone acrylamide/methacrylic acid/styrene/acrylic acid, about 121 mg/m$^2$ of polyacrylamide, about 124 mg/m$^2$ of dantoin and about 3 mg/m$^2$ of succinaldehyde;
4. a magenta dye developer layer comprising about 374 mg/m$^2$ of a magenta dye developer represented by the formula

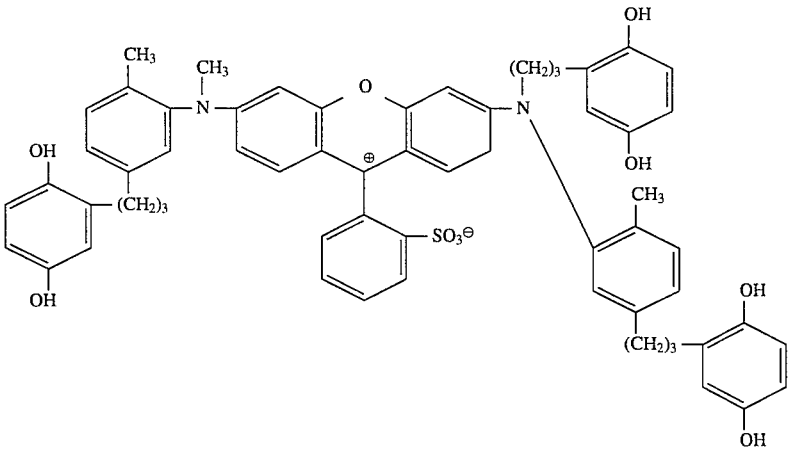

about 360 mg/m$^2$ of gelatin and about 500 mg/m$^2$ of 2-phenyl benzimidazole, and about 30 mg/m$^2$ of a cyan filter dye;

5. a spacer layer comprising about 281 mg/m$^2$ of carboxylated styrenebutadiene latex (Dow 620 latex) and about 94 mg/m$^2$ of gelatin;
6. a green-sensitive silver iodobromide layer comprising about 189 mg/m$^2$ of silver iodobromide (0.5 micron), about 142 mg/m$^2$ of silver iodobromide (0.6 micron), about 567 mg/m$^2$ of silver iodobromide (1.1 micron) and about 396 mg/m$^2$ of gelatin;
7. a layer comprising about 175 mg/m$^2$ of AMNHQ, about 30 mg/m$^2$ of bis (6-methylaminopurine) zinc salt and about 62 mg/m$^2$ of gelatin;
8. an interlayer comprising about 1448 mg/m$^2$ of the copolymer described in layer 4, about 76 mg/m$^2$ of polyacrylamide and about 4 mg/m$^2$ of succindialdehyde;
9. a layer comprising about 1100 mg/m$^2$ of a scavenger, 1-octadecyl-4, 4-dimethyl-2-[2-hydroxy-5-(N-(7-caprolactamido)sulfonamido] thiazolidine, about 40 mg/m$^2$ of a magenta filter dye and about 416 mg/m$^2$ of gelatin;
10. a yellow filter layer comprising about 295 mg/m$^2$ of benzidine yellow dye and about 118 mg/m$^2$ of gelatin;
11. a yellow image dye-providing layer comprising about 960 mg/m$^2$ of a yellow image dye-providing material represented by the formula

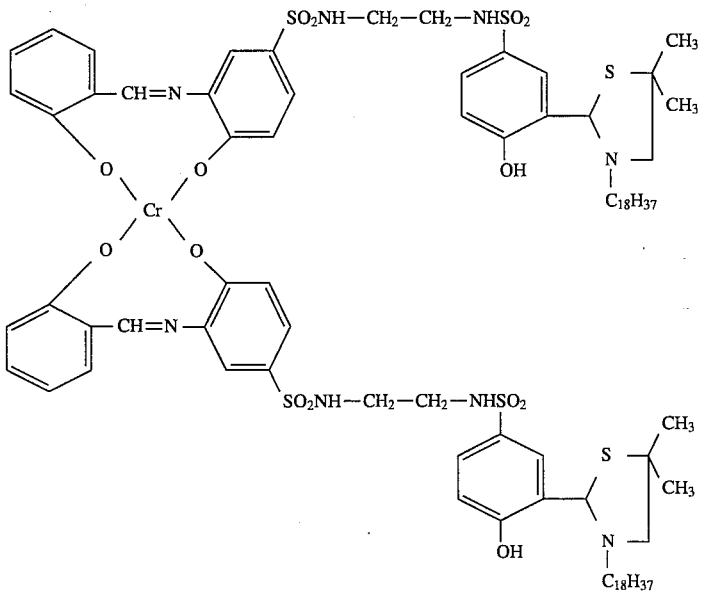

and about 274 mg/m$^2$ of gelatin;

12. a layer coated at a coverage of about 890 mg/m$^2$ of a hydrogen-bonded complex of norbornyltertiarybutyl hydroquinone and dimethylterephthalamide, 100 mg/m$^2$ of 5-t-butyl-2,3-bis[(1-phenyl-1H-tetrazol-5-yl)thio], -1, 4-benzenediol bis[(2-methanesulfonylethyl)carbamate] and about 371 mg/m$^2$ of gelatin;
13. a blue-sensitive silver iodobromide layer comprising about 29 mg/m$^2$ of silver iodobromide (0.9 micron), about 130 mg/m$^2$ of silver iodobromide (1.2 micron), about 130 mg/m$^2$ of silver iodobromide (2.1 micron) and about 144 mg/m$^2$ of gelatin;
14. a layer comprising about 450 mg/m$^2$ of an ultraviolet filter material, Tinuvin (Ciba-Geigy) and about 194 mg/m$^2$ of gelatin; and
15. a topcoat layer coated at a coverage of about 255 mg/m$^2$ of gelatin.

The Control -1 film unit was processed by initially exposing the photosensitive element to a standard sensitometric target, arranging the photosensitive and image-receiving elements in face to face relationship (i.e., with their respective supports outermost) and a rupturable container containing an aqueous alkaline processing composition affixed between the elements at the leading edge of the film unit such that the application of compressive pressure to the container would rupture the seal of the container along its marginal edge and distribute its contents uniformly between the respective elements. The chemical composition of the aqueous alkaline processing composition is set forth in Table I.

TABLE I

| Component | Parts by Weight |
|---|---|
| hypoxanthine | 0.98 |
| 1-methylimidazole | 0.29 |
| p-toluenesulfinate, sodium salt | 0.49 |
| guanine | 0.15 |
| potassium hydroxide | 8.69 |
| p-hydroxyphenylmercaptotetrazole | 0.005 |
| titanium dioxide | 0.20 |
| 6-methyluracil | 0.54 |

TABLE I-continued

| Component | Parts by Weight |
|---|---|
| pentanolamine | 1.96 |
| hydrophobically modified HEC | 2.99 |
| 1,2,4,-triazole | 0.35 |
| 3.5 dimethylpyrazole | 0.25 |
| phenylmercaptotetrazole | 0.0006 |
| 2-(methylamino)ethanol | 0.15 |
| butylpicolinium bromide | 2.15 |
| potassium bromide | 0.85 |
| Water | Balance to 100 |

The film unit was passed through a pair of pressure rollers set at a gap spacing of about 0.0034 inch and the photosensitive and image-receiving elements separated from each other after an imbibition period of 90 seconds. The image obtained on the image-receiving element was read with an Automatic Recording Densitometer with each column of the image being read individually. The saturation and tipper cut values for the cyan, magenta and yellow columns of the image are shown in Table II.

Uppercut is defined as the difference in dye density between the neutral column and the color column integrated between the white point and the speed point divided by the dye range..The speed point is the log of the exposure corresponding to 0.75 density and the white point is two stops slower than the speed point. An increase in the uppercut value indicates increased dye control in the toe region of the neutral column due to exposure of other emulsions.

EXAMPLE II

A film unit (A) according to the invention was prepared which was identical to the Control-1 film unit with the exception that it contained, between layers 13 and 14, an additional layer coated at a coverage of about 150 mg/m$^2$ of a second developer according to the invention, i.e., 2,5-ditertiarybutylhydroquinone, and about 102 mg/m$^2$ of gelatin.

Film Unit A was processed as described above. The saturation and uppercut values for the cyan, magenta and yellow columns of the image are shown in Table II.

EXAMPLE III

A Control-2 film unit was prepared which was identical to Control-1 with the exception that layer 12 was coated at a coverage of about 890 mg/m$^2$ of the NTBHQ complex, about 100 mg/m$^2$ of the blocked development restrainer and about 353 mg/m$^2$ of gelatin and layer 13 was coated at a coverage of about 48 mg/m$^2$ of silver iodobromide (0.9 micron), about 48 mg/m$^2$ of silver iodobromide (1.2 micron), about 144 mg/m$^2$ of silver iodobromide (2.0 micron) and about 120 mg/m$^2$ of gelatin.

The Control-2 film unit was processed as described previously. The saturation and uppercut values for the cyan, magenta and yellow columns of the image are shown in Table II.

EXAMPLE IV

A film unit (B) according to the inventions was prepared which was identical with the Control-2 film unit with the exception that it included, in place of layer 7, a layer coated at a coverage of 175 mg/m$^2$ of AMNHQ, about 30 mg/m$^2$ of the bis-(6-methylaminophrine) zinc salt, about 200 mg/m$^2$ of a second developer precursor according to the invention, namely 6-hydroxy, 4,4,5,7,8-pentamethyl dihydrocoumarin, and about 122 mg/m$^2$ of gelatin.

The film unit was processed as described above. The saturation and uppercut values for the cyan, magenta and yellow columns of the image are shown in Table II.

TABLE II

| | SATURATION | | | UPPERCUT | | |
|---|---|---|---|---|---|---|
| FILM UNIT | C | M | Y | C | M | Y |
| Control-1 | 1.05 | 1.65 | 1.11 | 777 | 672 | 331 |
| A | 1.16 | 1.83 | 1.09 | 579 | 238 | 421 |
| Control-2 | 1.14 | 1.66 | 1.10 | 699 | 650 | 429 |
| B | 1.21 | 1.85 | 1.15 | 530 | 616 | 264 |

These data illustrate the improvements exhibited by the film units of the invention. Film unit A, which included DTBHQ in the blue color component, exhibited decreased interimage effects between the green and blue color components (decreased control of diffusible magenta dye developer by the blue-sensitive silver halide) as evidenced by the significantly increased magenta saturation and significantly lower magenta uppercut. This film unit also exhibited decreased interimage effects between the red and green color components (decreased control of diffusible cyan dye developer by green-sensitive silver halide) as evidenced by the increased cyan saturation and the lower cyan uppercut.

Film unit B, which included the lactone compound in the green color component exhibited decreased interimage effects between the red and green color components (less control of diffusible cyan dye developer by green-sensitive silver halide) as evidenced by the increased cyan saturation and lower cyan uppercut.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A diffusion transfer photographic film unit comprising a photosensitive element comprising a support carrying at least two different color image components, each said color image component including a color-sensitive silver halide emulsion layer in association with a corresponding image dye-providing material, a first silver halide developer capable of participating in photographic development after photoexposure whereby an imagewise pattern of diffusible dye image-forming material is provided and wherein at least one of said color image components further includes a second silver halide developer, or precursor thereof, having an oxidation potential more negative than that of said first silver halide developer and capable of developing silver halide indiscriminately, said second silver halide developer being adapted to be made available after photographic development has been substantially completed in said color image component in which said second silver halide developer is located;

a second sheet-like element which is in superposed relationship, or adapted to be placed in superposed relationship, with said photosensitive element;

an image-receiving layer positioned in one of said photosensitive and second sheet like elements; and means providing an aqueous alkaline processing composition for distribution between predetermined layers of said elements.

2. A film unit as defined in claim 1 which includes a red image component comprising a red-sensitive silver halide emulsion layer in association with a cyan image dye-providing material, a green image component comprising a green-sensitive silver halide emulsion layer in association with a magenta image dye-providing material and a blue image component comprising a blue-sensitive silver halide emulsion layer in association with a yellow image dye-providing material.

3. A film unit as defined in claim 2 wherein said red image component is positioned closest to said support and said blue image component is positioned farthest from said support and wherein said green and blue image components each include one of said second silver halide developer materials or a precursor thereof.

4. A film unit as defined in claim 3 wherein said yellow image dye-providing material is an image dye-releasing thiazolidine and each of said cyan and magenta image dye-providing materials is a dye developer.

5. A film unit as defined in claim 4 wherein each said second silver halide developer has an oxidation potential more negative than about –400 mv.

6. A film unit as defined in claim 5 wherein each said second silver halide developer has an oxidation potential of from about –400 mv to about –550 mv.

7. A film unit as defined in claim 2 further including means providing a light-reflecting layer against which an image in said image-receiving layer may be viewed and wherein said second sheet-like element further includes a support and said image-receiving layer is positioned in said second sheet-like element.

8. A film unit as defined in claim 7 wherein said support of said second sheet-like element is opaque, said means providing a light-reflecting layer is a layer of light-reflecting pigment positioned between said image-receiving layer and said opaque support of said second sheet-like element, and said second sheet-like element is adapted to be separated from said photosensitive element after an image is formed in said image-receiving layer.

9. A film unit as defined in claim 1 wherein said means providing an aqueous alkaline processing composition is a rupturable container releasably holding said aqueous alkaline processing composition.

10. A film unit as defined in claim 2 wherein one of said color image components includes a second silver halide developer precursor represented by the formula

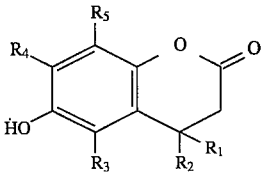

wherein $R_1$ and $R_2$ are each methyl and $R_3$, $R_4$, and $R_5$ can each independently be hydrogen, alkyl having from 1 to 4 carbon atoms or alkoxy having 1 to 4 carbon atoms.

11. A film unit as defined in claim 10 wherein another of said color image components includes a second silver halide developer selected from the group consisting of ditertiarybutylhydroquinone, ditertiaryaaryamylhydroquinone, ditertiaryoctylhydroquinone and norbornyltertiaryoctylhydroquinone and 2,3,5,6-tetramethylhydroquinone.

12. A film unit as defined in claim 11 wherein said second silver halide developer is 2,5-ditertiarybutylhydroquinone.

* * * * *